US006363760B1

(12) United States Patent
Sigmond

(10) Patent No.: US 6,363,760 B1
(45) Date of Patent: Apr. 2, 2002

(54) HANDGUN SECURITY WALL SAFE

(76) Inventor: Edward Sigmond, 1027 Danforth Ct., Arlington, TX (US) 76017

( * ) Notice: Subject to any disclaimer, the term of this patent is extended or adjusted under 35 U.S.C. 154(b) by 0 days.

(21) Appl. No.: 09/396,631

(22) Filed: Sep. 15, 1999

(51) Int. Cl.[7] ..... E05B 73/00

(52) U.S. Cl. ..... 70/63; 70/58; 109/50; 109/51; 312/242

(58) Field of Search ..... 70/63, 58; 109/50–52; 52/36.4; 206/317; 248/298.1, 295.11; 312/242, 245, 205

(56) References Cited

U.S. PATENT DOCUMENTS 3,464,606 A * 9/1969 Nordeen ..... 312/242 X
3,750,893 A * 8/1973 Kempler ..... 248/220.31 X
4,309,065 A * 1/1982 Pappas ..... 312/242
4,651,544 A * 3/1987 Hungerford ..... 70/63
4,768,021 A * 8/1988 Ferraro ..... 70/63 X
4,936,038 A * 6/1990 Johnson et al. ..... 312/204 X
4,987,836 A * 1/1991 Owen ..... 70/63 X
5,056,342 A * 10/1991 Prinz ..... 70/63
5,329,865 A * 7/1994 McWard ..... 70/63 X
5,375,440 A * 12/1994 Patterson ..... 70/63
5,460,020 A * 10/1995 Hungerford ..... 70/63
5,563,579 A * 10/1996 Carter ..... 70/63 X
5,901,589 A * 5/1999 Cordero ..... 70/63

* cited by examiner

*Primary Examiner*—Lloyd A. Gall
(74) *Attorney, Agent, or Firm*—Harold Levine, P.C.

(57) ABSTRACT

A security wall safe specially adapted for securing weapons such as pistols. The safe is made of sheet steel or other strong and inexpensive material such as plastic or composite and is sized to conveniently fit between conventional wall studs so that it can easily be installed in a manner similar to installation of a bathroom medicine cabinet. It includes a touch keypad on a surface that is exposed to view when in use (e.g., the door or the front facing adjacent the door if a front facing is provided); and provision is made for the optional selection or change of door-opening code for the keypad to any selected three to nine digit number. The electronic control, in addition to locking/unlocking the wall safe, is compatible with conventional security systems and may optionally be set to activate the panic mode of an attendant security system and/or transmit electronic indicia thereof to one or more remote monitoring/law enforcement installations. It may be battery powered, conventional alternating current powered, or a combination of both. Also disclosed is an optional adjustable bracket for adjustably mounting the wall safe.

16 Claims, 4 Drawing Sheets

HANDGUN SECURITY WALL SAFE

This invention relates to devices and methods for safeguarding weapons and more particularly to safeguarding and protecting handguns from unauthorized access while preserving ease of access by authorized individual(s).

BACKGROUND OF THE INVENTION

Cabinets providing safeguards and protection for weapons including guns have heretofore been proposed. Typically, such cabinets have included provision for locking so as to prevent access by unauthorized persons such as children. Where small weapons such as handguns are involved, such cabinets have included constructions such as wall safes. Illustrative of the latter is the disclosure of U.S. Pat. No. 5,586,934 which was granted to Larry A. Dombrowski et al on Dec. 24, 1996.

Other proposals have been made for compact safes in which small items might be stored. Illustrative of these are the disclosures of U.S. Pat. No. 4,172,424 granted to Manuel F. de Palau on Oct. 30, 1979; U.S. Pat. No. 4,821,652 granted to granted to Steven H. Hoffman on Apr. 18, 1989; U.S. Pat. No. 4,398,470 granted to Alvin R. Williams et al. on Aug. 16, 1983; and U.S. Pat. No. 4,370,935 granted to Lawrence R. Link on Feb. 1, 1983.

Although such proposals have addressed selected problems encountered in storing and protecting valuables, there yet have remain unresolved drawbacks to their use in home environments. Thus, among other problems, there have continued to be disadvantages with use of mechanical locking devices in situations in which quick (e.g., emergency) access to items such as handguns is needed. In such situations, for example, keys to mechanical locks may not be immediately available; or lock combinations may be forgotten or require significant amounts of time for use. Moreover, there may arise occasions in which time used for opening a safe may not permit separately sending an alarm to appropriate law enforcement agencies. Accordingly, there has continued to be a need for an improved wall safe-like construction that provides for rapid opening while concurrently sending electronic indicia to other locations (e.g., appropriate authorities).

BRIEF SUMMARY OF THE INVENTION

The improved devices and methods according to the invention hereof include simple and cost effective features that ameliorate adverse conditions and characteristics heretofore associated with prior use and conditions. Thus, in accordance with the preferred embodiment hereof, a touch pad is provided on an exterior surface for entering a multi-digit code for normally unlocking the weapons security safe, while such code or an optional alternate or additional code may be made effective to activate the panic mode of a security system and/or automatically signal law enforcement or other designated authorities.

The weapons safe according to the invention hereof is simple in construction and includes pegs that may be custom positioned to conform with geometries of weapons (e.g., guns such as handguns) intended for storage/protection.

OBJECTS AND FEATURES OF THE INVENTION

It is one general object of the invention to improve protection and access to weapons.

It is another object of the invention to facilitate firearm safety while providing quick access to stored weapons.

It is yet another object of the invention to reduce cost and complexity of protecting and storing weapons.

It is yet another object of the invention to improve rapidity of response to weapons-related emergencies by law enforcement personnel.

Accordingly, in accordance with one feature of the invention, a weapons protection wall safe is fitted on a front exterior surface with a touch activated multi-digit key pad for rapid entry of a multi-digit code for unlocking the safe, thereby facilitating rapid unlocking as in an emergency.

In accordance with another feature of the invention, the touch-activated key pad includes an option for changing its unlocking code, thereby contributing to its versatility and effectiveness.

In accordance with yet another feature of the invention, the touch-activated key pad includes an option for simultaneous unlocking and activating attendant panic mode equipment, thus contributing to its effectiveness in use.

In accordance with yet another feature of the invention, the weapons protection wall safe is optionally fitted with movable pegs, thus permitting customization of the interior support to specific geometries of weapons intended to be stored therein.

In accordance with still another feature of the invention, provision is made for supplying operating power for the lock from either a conventional alternating current power source, a replaceable battery, or both, thus enhancing dependability.

In accordance with yet one further feature of the invention, the weapons protection wall safe may be fastened into a conventional wall with adjustable brackets, thus facilitating its use and adaptability to installations with wall studs having varying spacings.

These and other objects and features of the invention will be apparent from the following description, by way of example of a preferred embodiment, with reference to the drawing.

DESCRIPTION OF A PREFERRED EMBODIMENT

Figure 1:
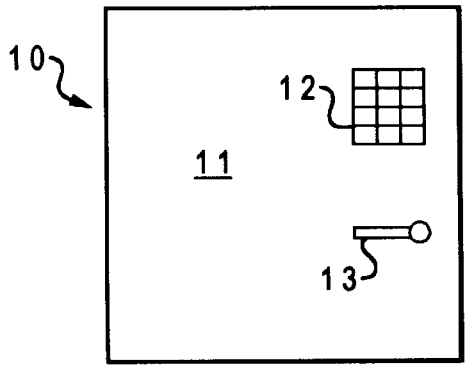
FIG. 1 is a front elevation view of a weapon security wall safe constructed in accordance with the invention.

Now turning to the drawing, and more particularly FIG. 1 thereof, it will be seen to be a front elevation view of a weapon security wall safe 10 in accordance with the invention. There, preferably on the front face 11 thereof is conventional touch pad 12 preferably having customary digits 0–9 together with other symbols such as a star (*) and pound sign (#). Also disposed on and projecting from the front face 11 is a conventional (optional) opening handle 13. Although the touch keypad 12 is preferably mounted on the door, it should be noted that if sufficient surrounding facing is provided about the door, such keypad could conveniently be mounted on the facing rather than on the door itself.

The dimensions and materials of the weapons security wall safe 10 are not critical. However, in accordance with the preferred embodiment, the exterior housing is of sheet steel or similar strong and inexpensive material such as, for example, high strength plastic or composite. In addition, so as to facilitate ease of mounting between wall studs, the side-to-side exterior dimension is selected to conform to, or be less than, conventional spacing between such wall studs. Such spacing may vary from location to location so as conform to applicable building codes; and so the safe may be provided in several different widths with accompanying shims or other mounting members; or it may be made with an adjustable bracket (e.g., FIGS. 8 and 8A). Such adjustable bracket may have telescoping flanges to facilitate lateral width adjustment and provide for custom adjustment to fit wall stud spacing. The height dimension, again, is not critical. One suitable dimension is that of approximately 12 inches so as comfortably to provide space for one or two conventional pistols. However, it should be understood that the height could be increased so as to comfortably accommodate several weapons. It should also be noted that the principles hereof are applicable to larger weapons (e.g., shotguns or rifles); and consequently the vertical dimension could be substantially greater or significantly smaller, depending on the dimensions and numbers of weapons intended for protection therein.

Figure 2:
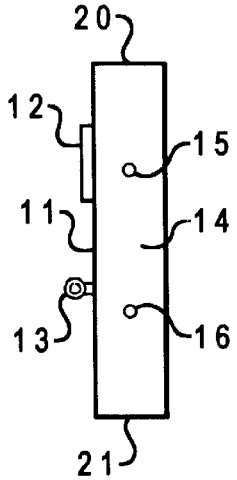
FIG. 2 is a right side elevation view of the safe of FIG. 1.
Figure 3:
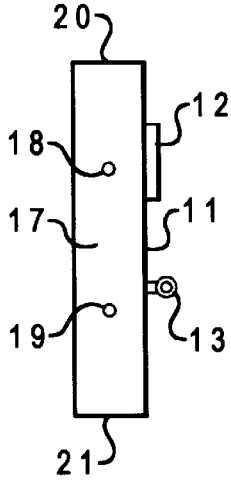
FIG. 3 is a left side elevation view of the safe of FIG. 1.
Figure 5:
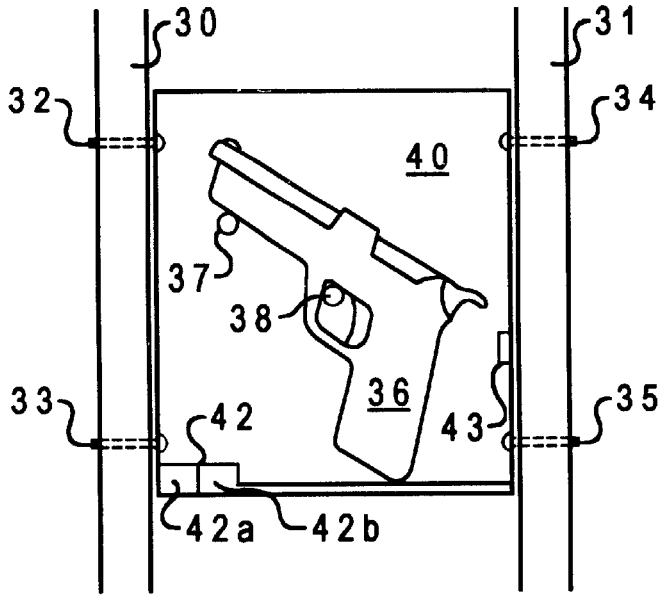
FIG. 5 is a view (without the closing door) of the weapon security wall safe of FIGS. 1–4 mounted between wall studs and illustrating mounting of a handgun therein according to the preferred embodiment hereof.

As mentioned above, FIG. 2 is a right side elevation view of the safe of FIG. 1. There, are seen the right side 14 in which one or more apertures such as apertures 15 and 16 are provided to facilitate fastening to a wall stud shims (FIG. 5) or a mounting bracket. Also seen are top 20 and bottom 21. Top 20 and bottom 21 are preferably fitted with small circular apertures spaced in registry with corresponding apertures in the security plates of FIGS. 8 and 8A as described below. FIG. 3 is a left side elevation view of the safe of FIG. 1. There, in FIG. 3, are the left side 17 in which one or more apertures such as apertures 18 and 19 are provided so as to facilitate fastening the left side to a wall stud (FIG. 5).

Since conventional 2×4 wall studs measure about 1½ by about 3½ inches in cross section, the preferable depth of the weapon security wall safe is made to be about 3 inches. Accordingly, the corresponding dimension in FIGS. 2 and 3 (depth of the security wall safe) preferably approximates 3 inches.

Figure 4:
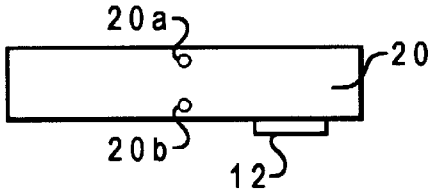
FIG. 4 is a top plan view of the safe of FIG. 1.

FIG. 4 is a top plan view of the safe of FIG. 1. There is depicted the top 20 with security plate fastening apertures 20*a* and 20*b*. Also depicted is keypad 12. However, to facilitate simplicity as well as to illustrate an embodiment in which there is no operating handle, the operating handle 13 is not shown.

At this point it may be helpful to point out that although an operating handle such as handle 13 is illustrated in some of the figures, an alternate embodiment having no operating handle is represented by FIG. 4, it being understood that the latching mechanism may release the door when it is activated upon entry of the designated code in the touch pad. Moreover, it is not necessary for there to be hinges on the door of the cabinet. The door may intentionally be made without hinges so that the door simply falls off when the operating code is entered in the key pad.

FIG. 5 is a view (not including door 11) of the weapon security wall safe 10 of FIGS. 1–4 mounted between exposed conventional wall studs such as studs 30 and 31. The security wall safe 10 may be installed in a manner similar to installing a bathroom medicine cabinet. It is inset into a wall and attached to the studs on both sides. Such attachment may be as illustrated in FIG. 5 or may be by means of brackets such as those illustrated in FIGS. 8 and 8A.

In FIG. 5 there will be seen four mounting members 32–35 which may be conventional lag screws or the like. These mounting members are selected in size to pass through apertures 15, 16, 18 and 19 and project into the studs 30 and 31 as illustrated to affix the security wall safe in position. To facilitate installation, one or more shims (not shown) may be employed if needed.

FIG. 5 also shows a conventional semi-automatic pistol 36 supported on two adjustable pegs 37 and 38. To facilitate customizing the locations of weapon-supporting pegs to fit the particular geometries of the selected weapon(s), a conventional peg board 40 is mounted to the interior rear surface of the cabinet. As is well known to those skilled in the mechanical arts, conventional peg boards are characterized by having a large number of small circular holes in the principal surface that is exposed when the board is in use. Such holes are ordinarily uniformly spaced apart at close intervals so as to facilitate locating mating pegs at desired positions within acceptable tolerances.

Also shown in FIG. 5 is a small sub-compartment 42 adapted to contain conventional circuitry 42*a* that is connected to touch pad 12 and conventional door latching assembly 43 by conventional wiring so as to unlatch door 11 upon entry of a selected code into touch pad 12. Sub-compartment 42 may be made sufficiently large to house a small battery 42*b* in battery-operated models. As previously mentioned, the electronics may be made exclusively battery powered, alternating current powered, or it may be powered by both battery and conventional a-c house current. In addition, the electronics include the capability of being responsive to codes of from 3 to 9 digits which may be entered serially or in combinations of concurrently entered keystrokes.

As previously mentioned, provision is also made for optional connection and integration of electronic circuitry 42*a* into a home or remote security system. In such event, an electrical signal is communicated to conventional terminals on the exterior of the security wall safe to facilitate making such connection. Conventional terminals may also be employed on the top, bottom or rear of the unit for connection of the conventional a-c power source mentioned above.

Figure 6:
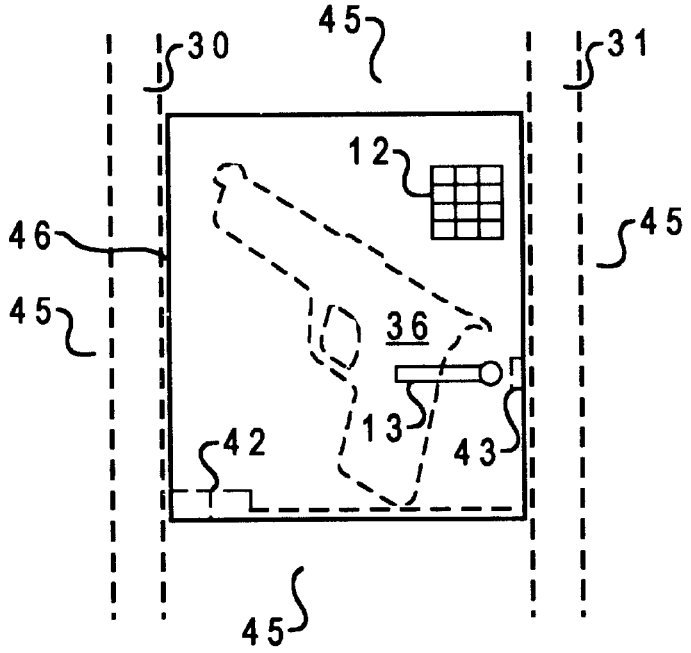
FIG. 6 is a view similar to that of FIG. 5 except showing the safe with its door in place and in the closed position.

Now turning to FIG. 6, it will be seen to be a view similar to that of FIG. 5 except that in FIG. 6, door hinges 46 are included, door 11 is shown in its closed position, and sheet rock 45 or similar adjacent wall material is also included.

Figure 7:
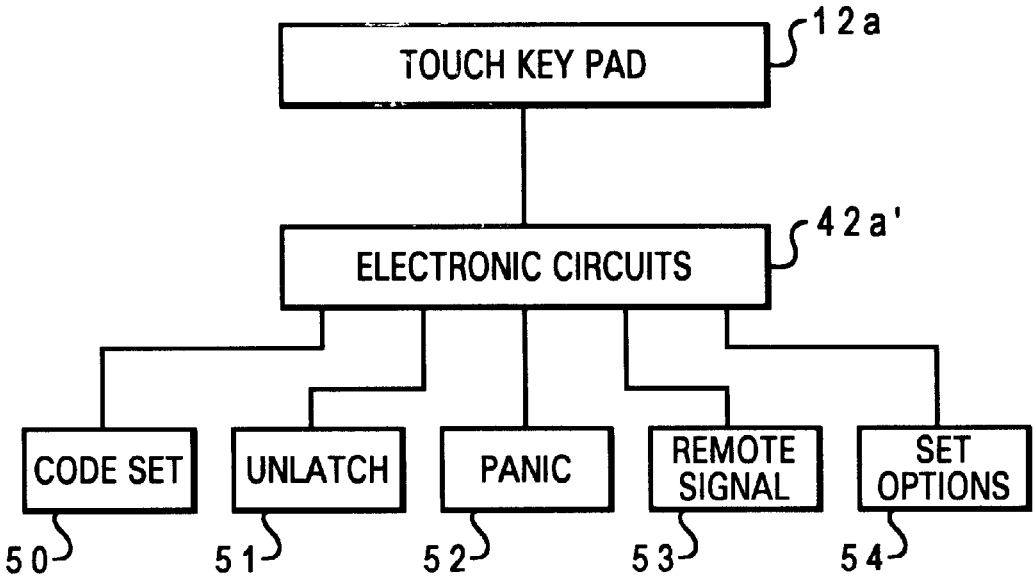
FIG. 7 is a block diagram illustrating operation of electronic components.

As previously mentioned, provision is made for changing the aforementioned unlocking code. This may be readily accomplished in known ways by resetting the code through manipulation of a selected key once the previously selected code has been entered into the keypad. In addition, by programming the electronics through manipulation of selected keys, the electronics may be conditioned to unlatch the access lock only, unlatch the lock with attendant activation of a panic mode alarm, transmit a panic-type signal to a remote monitoring location, or a combination thereof FIG. 7 illustrates foregoing features including interrelationships. There is shown the touch key pad 12*a* interconnected with electronic circuits 42*a'*. As previously mentioned, provision is made within the electronic circuits for setting the code as represented by block 50; latching and unlatching the safe door as represented by block 51; cooperating with a conventional security system to activate its panic mode as represented by block 52; sending a signal to a remote monitoring facility as represented by block 53; and selecting desired options for system operation as represented by block 54. Such selection envisions selecting individual or concurrent unlatching/panic/remote actions as are described above.

Figure 8A:
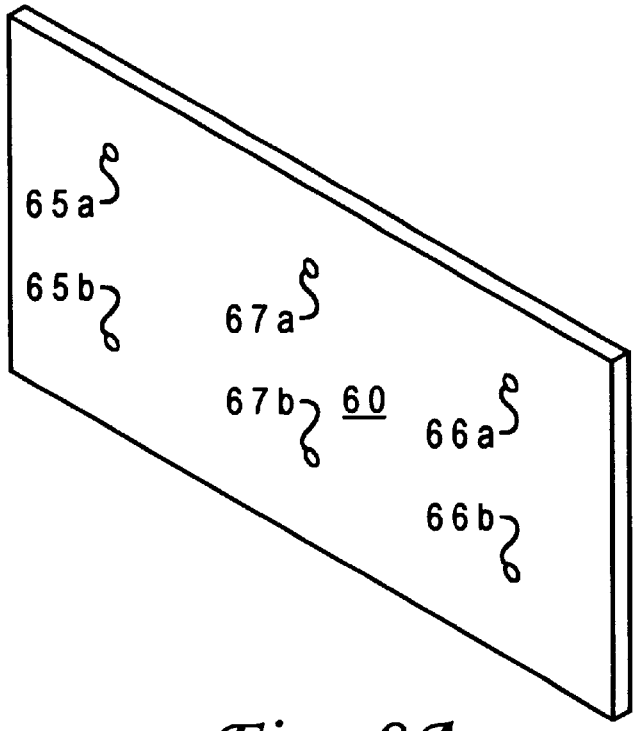
FIG. 8A is a detail of the securing base of the bracket of FIG. 8.
Figure 8:
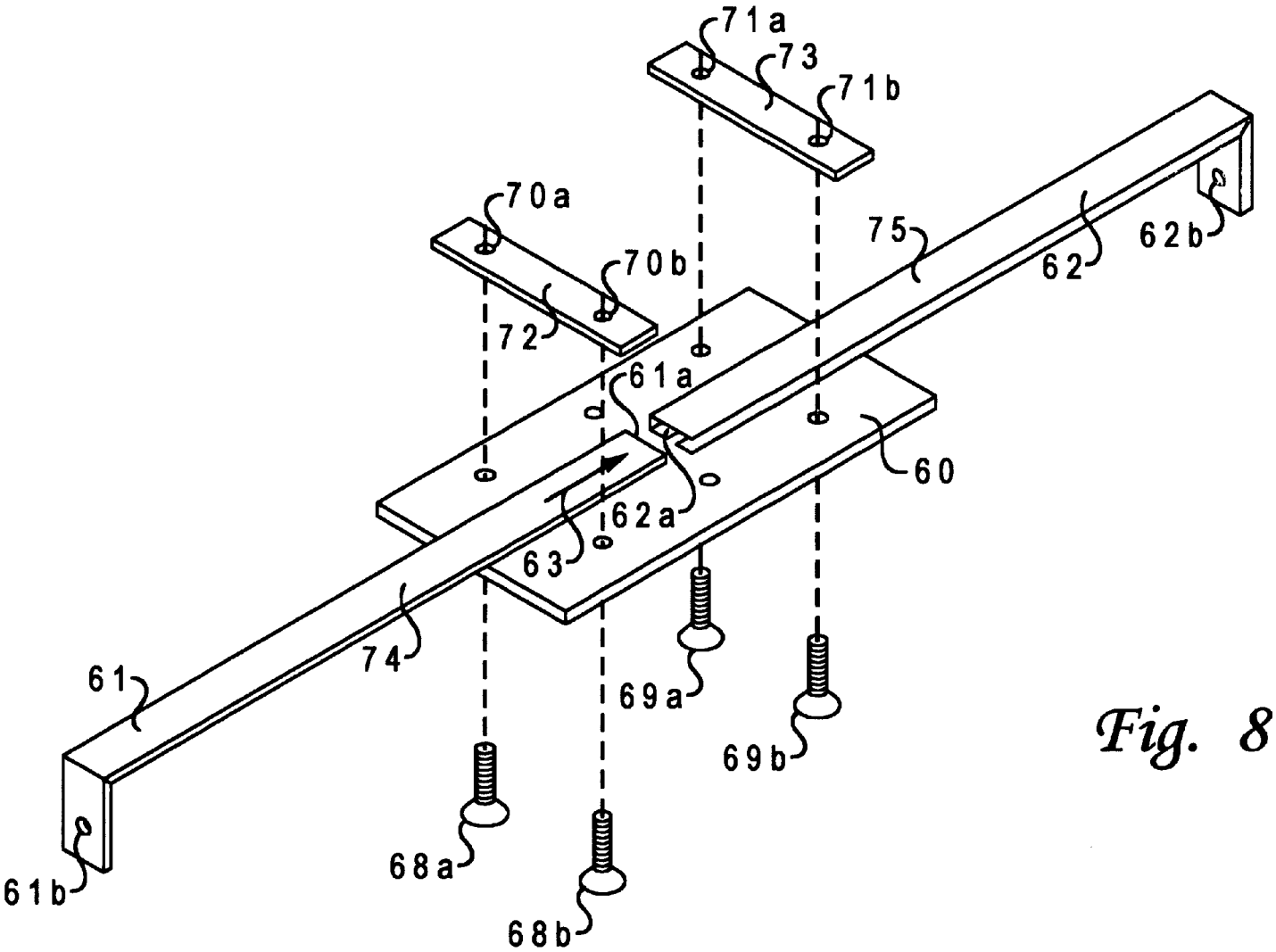
FIG. 8 is a perspective view of a preferred mounting bracket which provides adjustability.

FIGS. 8 and 8A illustrate the adjustable mounting bracket preferred for adjustably mounting the wall safe between conventional wall studs. There, in FIG. 8 are seen securing base 60 which preferably (but not necessarily) is rectangular in geometry. Securing base 60 may be of steel, composite, plastic or other suitable materials. It is included to connect the top 20 and/or bottom 21 of the wall safe to adjusting bracket arms 61 and 62. As will be observed from further reference to the figures, adjusting bracket arms 61 and 62 are adapted to fit in telescoping engagement, with end 61*a* engaging end 62*a* and slidably entering therein as represented by arrow 63. Thus, the distance between fastening apertures 61*b* and 62*b* is adjustable so as to accommodate different spacing of mounting wall studs as mentioned above. At this point, it will be evident to one skilled in this art that fastening screws or the like will be disposed within apertures 61*b* and 62*b* for attachment to wall studs as discussed above.

It should also be noted that although two bracket mounting assemblies may be employed, one at the top and the other at the bottom of the wall safe, in some installations only one such assembly may be used. Where two are employed, the assembly for attachment to the bottom of the wall safe is identical to that for the top (FIGS. 8 and 8A) but turned upside down so that it in effect is a mirror image of the assembly for the top.

Turning again to FIGS. 8 and 8A, securing base 60 is seen to be fitted with a plurality of apertures 65*a*–67*b*. Apertures 65*a*, 65*b*, 66*a* and 66*b* are provided to accept taper headed machine threaded bolts 68*a*, 68*b*, 69*a* and 69*b* respectively. These bolts pass through the apertures so as to engage with threaded recesses/apertures 70*a*–71*b* as illustrated in FIG. 8. Accordingly, when bolts 68*a*–69*b* are tightened, base clamping members 72 and 73 are tightened into frictional engagement with the top surfaces 74 and 75 of telescoping members 61 and 62, thereby locking them in place after they have been adjusted to fit between wall studs as described above.

The remaining apertures in securing base member 60, i.e., apertures 67*a* and 67*b* are provided to accept threaded bolts (not shown) similar to bolts 68*a*–69*b*, which extend through apertures 20*a*/20*b* (FIG. 4) and/or corresponding apertures in the bottom of the wall safe, so as to fasten the bracket assembly to the wall safe.

It will now be evident that there has been described herein an improved security wall safe and mounting bracket exhibiting improved features which facilitate protecting weapons while preserving their ready access to authorized persons. Although the inventions hereof have been described by way of preferred embodiments, it will be evident that adaptations and modifications may be employed without departing from the spirit and scope thereof. For example, other mounting brackets may be employed, or the electronic circuitry may be positioned in another location than that illustrated for the preferred embodiment.

The terms and expressions employed herein have been used as terms of description and not of limitation; and thus, there is no intent of excluding equivalents, but on the contrary it is intended to cover any and all equivalents that may be employed without departing from the spirit and scope of the inventions.

What is claimed is:

1. A weapon security wall safe system comprising a wall safe having:

(a) a compartment having an interior, an exterior, and an opening providing access to said interior;

(b) a door for opening and closing said compartment, said door having an exterior surface exposed to view when said door is in a closed position, said door when in an open position exposing said interior and when in said closed position closing said opening thereby sealing said compartment;

(c) a multi-digit keypad on said wall safe;

(d) means for selecting a multi-digit unlocking code;

(e) means within said compartment for supporting a weapon;

(f) locking means normally effective for locking said door in said closed position when said door is closed; said locking means being responsive to entry of said multi-digit unlocking code in said keypad for unlocking said door; and (g) an adjustable mounting means for mounting said wall safe; said adjustable mounting means comprising:

(i) a pair of securing plates affixed to top and bottom of said wall safe; and (ii) a pair of telescoping members disposed adjacent top and bottom of said wall safe.

2. A weapon security wall safe system according to claim 1 wherein said means for supporting a weapon includes means for supporting a handgun.

3. A weapon security wall safe system according to claim 2 wherein said means for supporting a handgun includes a plurality of pegs detachably attachable to an interior surface of said compartment at selectable locations within said compartment.

4. A weapon security wall safe system according to claim 1 wherein said multi-digit keypad is located on an exterior surface of said wall safe.

5. A weapon security wall safe system according to claim 4 wherein said multi-digit keypad is located on said door.

6. A weapon security wall safe system according to claim 1 wherein said multi-digit keypad is electronic.

7. A weapon security wall safe system according to claim 1 wherein said wall safe includes a single access opening.

8. A weapon security wall safe system according to claim 1 wherein electric power for operating said locking means includes a battery power source.

9. A weapon security wall safe system according to claim 1 wherein electric power for operating said locking means includes a conventional alternating current power source.

10. A weapon security wall safe system according to claim 1 wherein electric power for operating said locking means includes both a conventional alternating current power source and a battery power source.

11. A weapon security wall safe system according to claim 1 wherein said keypad includes means for selecting said multi-digit unlocking code.

12. A weapon security wall safe system according to claim 11 wherein said keypad further includes means for changing said multi-digit unlocking code.

13. A weapon security wall safe system according to claim 11 further including panic mode alarm means and wherein said multi-digit unlocking code, when entered in said keypad is effective to activate said panic mode alarm means.

14. A weapon security wall safe system according to claim 13 further including means effective upon activation of said panic mode alarm means for transmitting alarm indicia to a remote location.

15. A weapon security wall safe system according to claim 14 wherein said remote location includes law enforcement authority.

16. A weapon security wall safe system according to claim 1 wherein said door and walls of said interior are formed of steel.

* * * * *